US009245511B1

(12) United States Patent
Ando

(10) Patent No.: US 9,245,511 B1
(45) Date of Patent: Jan. 26, 2016

(54) ULTRATHIN ELECTROMAGNETIC DRIVER AND ELECTRIC GUITAR INCLUDING THE SAME

(71) Applicant: Fernandes Co., LTD, Tokyo (JP)

(72) Inventor: Yoshihiro Ando, Tokyo (JP)

(73) Assignee: Fernandes Co., Ltd., Tokyo (JP)

( * ) Notice: Subject to any disclaimer, the term of this patent is extended or adjusted under 35 U.S.C. 154(b) by 0 days.

(21) Appl. No.: 14/806,480

(22) Filed: Jul. 22, 2015

(30) Foreign Application Priority Data

Aug. 22, 2014 (JP) ..... 2014-169634

(51) Int. Cl.
*G10H 3/18* (2006.01)
*G10H 5/14* (2006.01)
*G10H 3/26* (2006.01)

(52) U.S. Cl.
CPC ... *G10H 5/14* (2013.01); *G10H 3/26* (2013.01)

(58) Field of Classification Search
CPC ..... G10H 3/26; G10H 3/24
USPC ..... 84/725, 726, 737
See application file for complete search history.

(56) References Cited

U.S. PATENT DOCUMENTS

| | | | | | |
|---|---|---|---|---|---|
| 4,852,444 | A | | 8/1989 | Hoover et al. | |
| 4,907,483 | A | | 3/1990 | Rose et al. | |
| 4,941,388 | A | | 7/1990 | Hoover et al. | |
| 5,070,759 | A | | 12/1991 | Hoover et al. | |
| 5,123,324 | A | * | 6/1992 | Rose et al. | 84/726 |
| 5,233,123 | A | * | 8/1993 | Rose et al. | 84/726 |
| 5,292,999 | A | * | 3/1994 | Tumura | 84/728 |
| 5,497,690 | A | * | 3/1996 | Soupios | 84/453 |
| 5,523,526 | A | * | 6/1996 | Shattil | 84/728 |
| 5,585,588 | A | * | 12/1996 | Tumura | 84/726 |
| 5,932,827 | A | * | 8/1999 | Osborne et al. | 84/726 |
| 6,034,316 | A | * | 3/2000 | Hoover | 84/738 |
| 2005/0081703 | A1 | * | 4/2005 | Hoover | 84/726 |
| 2009/0064853 | A1 | * | 3/2009 | Gillette | 84/725 |
| 2009/0223353 | A1 | * | 9/2009 | Loftus | 84/726 |
| 2010/0263521 | A1 | * | 10/2010 | Ierymenko et al. | 84/726 |
| 2014/0096668 | A1 | | 4/2014 | McMillen | |

FOREIGN PATENT DOCUMENTS

| | | | |
|---|---|---|---|
| JP | 3233659 | B | 11/2001 |
| JP | 3267317 | B2 | 3/2002 |
| JP | 3308288 | B2 | 7/2002 |
| JP | 3504542 | B2 | 3/2004 |
| JP | 3506083 | B2 | 3/2004 |
| WO | 8911717 | A1 | 11/1989 |
| WO | 9013888 | A1 | 11/1990 |

* cited by examiner

*Primary Examiner* — Jeffrey Donels
(74) *Attorney, Agent, or Firm* — Shumaker & Sieffert, P.A.

(57) ABSTRACT

A string vibration sustaining device according to the present embodiment includes a rear pickup converting string vibration into an electrical signal, an amplifier amplifying the converted electrical signal, and an ultrathin electromagnetic driver converting the amplified electrical signal into a magnetic signal to excite strings. The ultrathin electromagnetic driver includes two magnetic pole plates formed of a magnetic material, a rare earth magnet arranged in parallel with the strings between the two magnetic pole plates, and a coil wound in a direction perpendicular to the strings around the rare earth magnet, is formed to be ultrathin to have an entire thickness equal to or smaller than 3 mm, and is arranged in a slight gap between a neck end portion and a front pickup of the electric guitar.

7 Claims, 8 Drawing Sheets

ULTRATHIN ELECTROMAGNETIC DRIVER AND ELECTRIC GUITAR INCLUDING THE SAME

CROSS REFERENCE TO RELATED APPLICATION

This application is a new U.S. patent application that claims benefit of JP 2014-169634, filed on Aug. 22, 2014. The entire content of JP 2014-169634 is hereby incorporated by reference.

TECHNICAL FIELD

The present invention relates to an electromagnetic driver used in a string vibration sustaining device provided in an electric guitar that includes an electromagnetic pickup (referred to as a "pickup" as well).

BACKGROUND

Generally, an electric guitar needs no or a small inner resonance space for natural amplification of string vibration, compared with an acoustic guitar such a classic guitar, a flamenco guitar, and a folk guitar. Accordingly, a degree of freedom of a form and a design is large, and products of electric guitars having various shapes and forms are designed and on the market.

However, concerning a basic configuration of an electric guitar, two types of models illustrated in FIG. 7 and FIG. 8 are representatively standard.

The electric guitar illustrated in FIG. 7 is a type (referred to as "Gibson (registered trademark)" type in the following) of which the product name is the "Les Paul (registered trademark)" model announced by Gibson (registered trademark) Guitar Corporation in 1952. The electric guitar illustrated in FIG. 8 is a type (referred to as "Fender (registered trademark)" type in the following) of which the product name is the "Stratocaster (registered trademark)" model announced by Fender (registered trademark) Musical Instruments Corporation in 1954.

These two types are used by quite a number of prominent musicians and are the most famous models in the world. Ninety percent or more of electric guitars on the market have basic configurations that are the same as the configurations of these two types of models or that are derivatives of a configuration or combination of these two types of models.

Beginning from these two representative types of models, substantially all electric guitars are each provided with a plurality of electromagnetic pickups.

For example, two electromagnetic pickups are mounted in a main body 2 of the Gibson type of electric guitar 1 illustrated in FIG. 7. The pickup mounted at the end of a neck 3 is called a front pickup 4, and the pickup mounted at the bridge 5 is called a rear pickup 6.

The front pickup 4 and rear pickup 6 are each attached to the main body 2 via a pickup mounting frame body called an escutcheon 7.

Another configuration of the Gibson type of electric guitar 1 is as follows.

The electric guitar 1 includes strings 8, a tail piece 9, a pickup selecting switch 10, control knobs 11, an output jack 12, a pickguard 13, and strap pins 14. Each of the strings 8 are held by a string tuning peg (not illustrated) at a distal end of the neck 3, and passes over the bridge 5 such that the other ends of the strings 8 are held by the tail piece 9. The control knobs 11 can control volume and sound quality (tone).

In the case of the Fender type of electric guitar 15 illustrated in FIG. 8, three electromagnetic pickups are mounted. The pickup mounted at the neck 3 is called a front pickup 16, the pickup mounted at the bridge 17 is called a rear pickup 18, and the pickup mounted in the middle is called a center (or middle) pickup 19.

The front pickup 16, rear pickup 18, and center pickup 19 are attached to the main body 2 via a pickguard 20 formed of a plastic plate or an aluminum plate.

General electric guitars have the above-described configurations. Particularly, a combination of front pickup 4 and rear pickup 6, or front pickup 16, rear pickup 18, and center pickup 19 are mounted to have an important role in musical expression.

The front pickup 4, 16 is attached close to the neck 3. Accordingly, string vibration detected by the front pickup 4, 16 includes a large fundamental tone component and relatively small harmonic overtones so that its tone has a soft and warm sound characteristic.

The rear pickup 6, 18 is attached close to the bridge 5, 17. Accordingly, string vibration detected by the rear pickup 6, 18 includes a smaller fundamental tone component and relatively large harmonic overtones so that its tone has a hard, sharp, and bright sound characteristic.

The center pickup 19 of the latter type has a sound characteristics intermediate between those of the front pickup 16 and the rear pickup 18.

Mounted in the electric guitar 1, 15 is a pickup selecting switch 10 that makes switching between the front pickup 4 and the rear pickup 6, or among the front pickup 16, the rear pickup 18, and the center pickup 19 possible. In the pickup selecting switch 10, two or more out of the front pickup 4, 16, the rear pickup 6, 18, and the center pickup 19 can be simultaneously turned on so that combined sound characteristics can be obtained, as well.

Thus, the electric guitar 1, 15 includes a combination of the mounted front pickup 4 and rear pickup 6, or the mounted front pickup 16, rear pickup 18, and center pickup 19, and includes the selecting mechanism. Accordingly, a musician can play by selecting the pickup in accordance with sound characteristics necessary for expressing his or her own music.

A musician often plays while changing sounds even in single tune by using the front pickup 4, 16 with a soft and warmer sound characteristic at the time of playing a rhythm, and using the rear pickup 6, 18 with a hard and sharp sound characteristic at the time of playing a lead (melody or improvisation), for example.

In other words, in such an electric guitar, it is an essential to mount a plurality of pickups as structural elements.

Generally, an electric guitar has the characteristic that string vibration becomes maximum at the time of picking (or plucking), and then attenuates.

This is the greatest characteristic of what is called a plucked string instrument, i.e., a group of musical instruments to which a guitar belongs. Recently, a string vibration sustaining device that makes string vibration last permanently by electromagnetic energy has been proposed, and has been favorably reviewed in that new expression can be created in an electric guitar.

This string vibration sustaining device has been put on the market by the present applicant with the product name of "FERNANDES SUSTAINER (registered trademark)". In addition, another string vibration sustaining device has been put on the market by Mr. Alan Hoover in America with the product name of "SUSTAINIAC". Further, in the past, a string vibration sustaining device was put on the market by Mr. Floyd Rose in America with the product name of "Floyd Rose•SUSTAINER".

The techniques of the string vibration sustaining devices of these three parties are disclosed in U.S. Pat. No. 4,852,444 (Alan A. Hoover et al.) (referred to as "document 1" in the following), International Patent Application Publication No. WO90/13888 (Alan A. Hoover et al.) (referred to as "document 2" in the following), International Patent Application Publication No. WO89/11717 (Floyd D. Rose et al.) (referred to as "document 3" in the following), U.S. Pat. No. 5,292,999 (Fernandes (registered trademark) Co., Ltd) (referred to as "document 4" in the following), and U.S. Pat. No. 5,585,588 (Fernandes (registered trademark) Co., Ltd) (referred to as "document 5" in the following).

The string vibration sustaining devices disclosed in the documents 1 to 5 basically have the following configuration.

The string vibration sustaining device is constituted by a rear pickup that detects a frequency of string vibration and converts the detected frequency of string vibration into an electrical signal, an amplifier that amplifies the converted electrical signal, and an electromagnetic driver that converts the amplified electrical signal into a magnetic signal to excite strings.

The electromagnetic driver in such a conventional string vibration sustaining device is desirably mounted near the neck since it is dynamically difficult to excite strings near the bridge because of the configuration of an electric guitar for giving sufficient exciting force to the strings. In other words, the electromagnetic driver is required to be mounted at the position where the strings are most easily excited, i.e. where the front pickup was originally arranged.

This leads to a serious difficulty for the electric guitar in that the front pickup which is indispensable for the electric guitar as described above cannot be mounted near the neck of the electric guitar, and musical expression of the front pickup is spoiled.

To overcome this difficulty, as disclosed in the document 2 by the above-mentioned Mr. Alan Hoover, there is proposed a technique of using the electromagnetic driver as the front pickup when the electromagnetic driver is not used as the exciting device.

The electromagnetic driver basically has a configuration similar to that of the pickup. However, for exciting the strings, a winding number and a wire diameter of a coil of the electromagnetic driver are different from those of the pickup. For this reason, when the electromagnetic driver is used as it is to function as the front pickup, a detected signal is weak. In view of this, according to the technique of the document 2, the detected signal is amplified up to a level of a signal of the pickup by one or both of a boosting transformer and an operational amplifier.

In this way, a sound characteristic approximately similar to that of the front pickup can be obtained. However, there is a problem in that the signal is inevitably processed by the operational amplifier and an internal circuit of the string vibration sustaining device, resulting in an actively operating pickup, and for this reason, the signal becomes largely deviated from the exact original signal of the front pickup.

As described above, the electromagnetic driver and the pickup basically use coils of which wire diameters and winding numbers are different from each other. Accordingly, even when amplification and boosting is appropriately performed, it is difficult to obtain a fundamental sound characteristic of the front pickup.

Meanwhile, since the front pickup inevitably becomes an actively operating pickup as described above, there is a difficulty in that electric power needs to be supplied by a battery for operating the amplifier even when the string vibration sustaining device itself is not used, and when the battery is used up, a sound signal cannot be output at all.

From a different standpoint of suppressing magnetic feedback that is the most difficult problem in this type of string vibration sustaining device, it is necessary to arrange the electromagnetic driver and the rear pickup as far apart from each other as possible.

In other words, since the electromagnetic driver radiates strong magnetic energy while performing excitation, a part of the magnetic energy enters the rear pickup, and as a result, oscillation is caused to output an unnecessary noise other than an original musical signal of a musical instrument.

As a technique for suppressing such magnetic feedback, a string vibration sustaining device adopting "a magnetic unequilibrium device (shunt plate)" disclosed in the document 2 by the above-mentioned Mr. Alan Hoover was developed. "Horizontal structure drivers" disclosed in the documents 4 and 5 by the present applicant were developed as well.

These techniques effectively enable practical implementation of a string vibration sustaining device. To suppress the magnetic feedback most ideally and theoretically, it was necessary to arrange the electromagnetic driver and the rear pickup as far apart from each other as possible. However, in a string vibration sustaining device in which the electromagnetic driver is arranged at the conventional position of the front pickup, greater separation than at present is impossible.

SUMMARY

The present invention solves the above-described problem, and an object of the present invention is to provide an ultrathin electromagnetic driver used in a string vibration sustaining device, that enables an original front pickup to be mounted at an original position, and that enables the same front pickup sound as that of a conventional electric guitar to be obtained when the string vibration sustaining device is not used.

An object of the present invention is to provide an ultrathin electromagnetic driver that is used in a string vibration sustaining device, that enables a rear pickup detecting string vibration and the electromagnetic driver to be arranged apart from each other at the maximum distance in a limited space, and that enables influence of magnetic feedback entering the rear pickup to be suppressed as much as possible.

Further, an object of the present invention is to provide an ultrathin electromagnetic driver that is used in a string vibration sustaining device, and that is made ultrathin to have thickness of approximately 3 mm so that the magnetic energy radiated from the electromagnetic driver can converge at a position near strings with pinpoint accuracy, and influence of magnetic feedback can be thereby suppressed.

An object of the present invention is to provide an electric guitar that includes a string vibration sustaining device mounted thereon and including an ultrathin electromagnetic driver as described above so as not to deteriorate a sound creating performance of an original electric guitar.

An ultrathin electromagnetic driver according to the present embodiment is an ultrathin electromagnetic driver used in a string vibration sustaining device mounted on an electric guitar, wherein the string vibration sustaining device includes: a rear pickup that detects a frequency of string vibration, and converts the detected frequency of the string vibration into an electrical signal; an amplifier that amplifies the converted electrical signal; and the ultrathin electromagnetic driver that converts the amplified electrical signal into a magnetic signal to excite strings; the ultrathin electromagnetic driver including two magnetic pole plates formed of a magnetic material, a rare earth magnet arranged in parallel with the strings to be positioned between the two magnetic pole plates, and a coil wound in a direction perpendicular to the strings around the rare earth magnet, is formed in an ultrathin shape to have an entire thickness equal to or smaller than 3 mm, and is arranged in a gap between a neck end portion and a front pickup of the electric guitar.

An electric guitar according to the present embodiment is an electric guitar including a string vibration sustaining device, wherein the string vibration sustaining device includes: a rear pickup that detects a frequency of string vibration, and converts the detected frequency of the string vibration into an electrical signal; an amplifier that amplifies the converted electrical signal; and an ultrathin electromagnetic driver that converts the amplified electrical signal into a magnetic signal to excite strings; the ultrathin electromagnetic driver including two magnetic pole plates formed of a magnetic material, a rare earth magnet arranged in parallel with the strings to be positioned between the two magnetic pole plates, and a coil wound in a direction perpendicular to the strings around the rare earth magnet, is formed in an ultrathin shape to have an entire thickness equal to or smaller than 3 mm, and is arranged in a gap between a neck end portion and a front pickup of the electric guitar.

The ultrathin electromagnetic driver is formed in an ultrathin shape to have a thickness of approximately 3 mm so that the ultrathin electromagnetic driver can be mounted in the slight gap between the neck end portion and the front pickup of the electric guitar, which was an impossible configuration for a conventional electromagnetic driver.

The ultrathin electromagnetic driver is mounted farther away (closer to the neck) than the position of the front pickup where a conventional electromagnetic driver is mounted so that the magnetic feedback can be more suppressed.

The ultrathin electromagnetic driver is formed in an ultrathin shape to have a thickness of approximately 3 mm so that most of the magnetic radiation for the excitation converges, and for this reason, it is possible to effectively suppress a magnetic noise entering the rear pickup, and suppress the magnetic feedback as much as possible.

BRIEF DESCRIPTION OF THE DRAWINGS

Other features and advantages of the present invention will be apparent from the ensuing description, taken in conjunction with the accompanying drawings, in which.

DESCRIPTION

Figure 7:
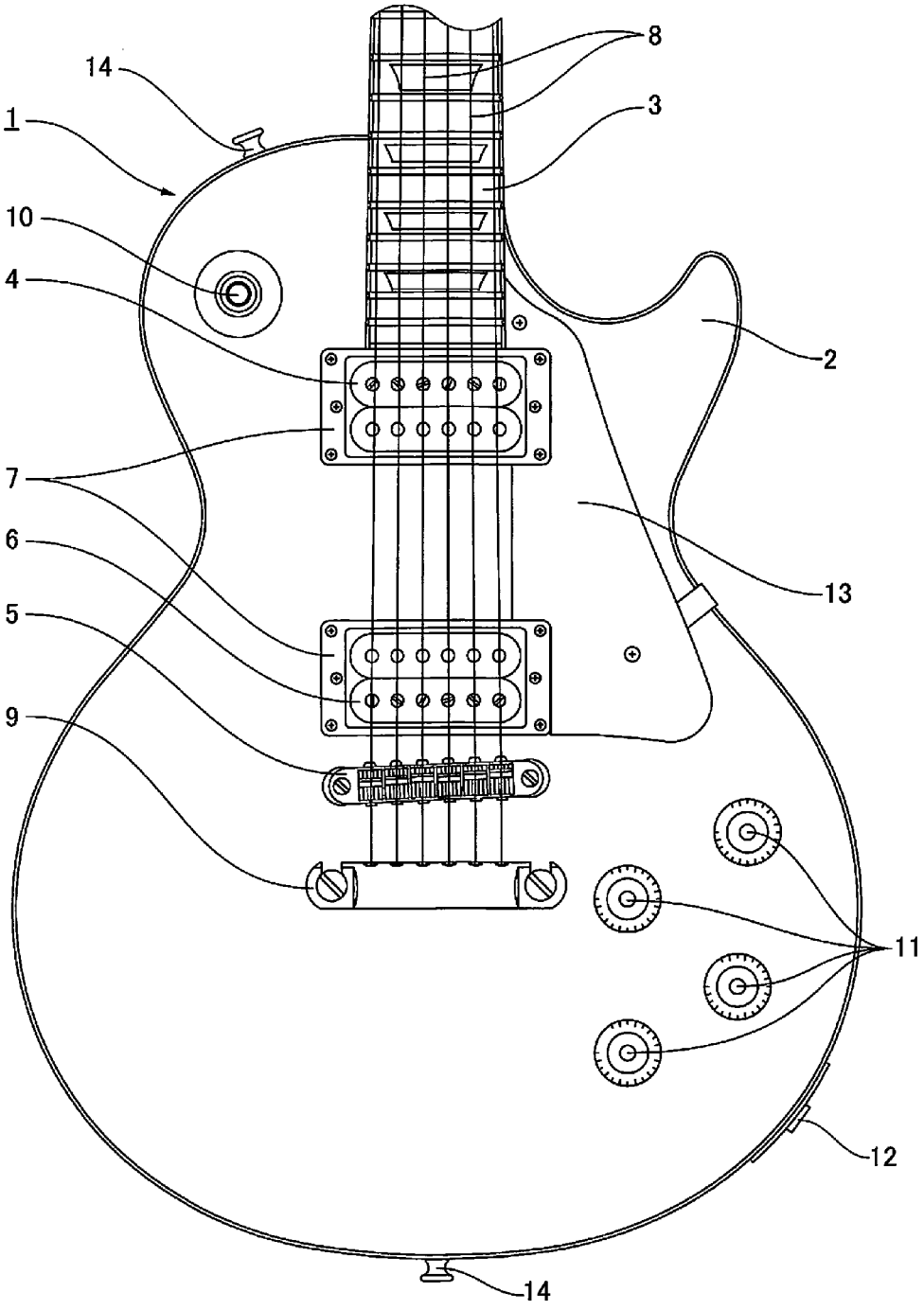
FIG. 7 RELATED ART
FIG. 7 is an elevational view illustrating a general Gibson type of electric guitar.

In the following, an embodied example in which the present invention has been applied to a Gibson type electric guitar is described in detail with reference to FIG. 1 to FIG. 5. For the same constituent components described above in the basic configuration of FIG. 7, the same reference symbols are attached, and a description is omitted.

Figure 1:
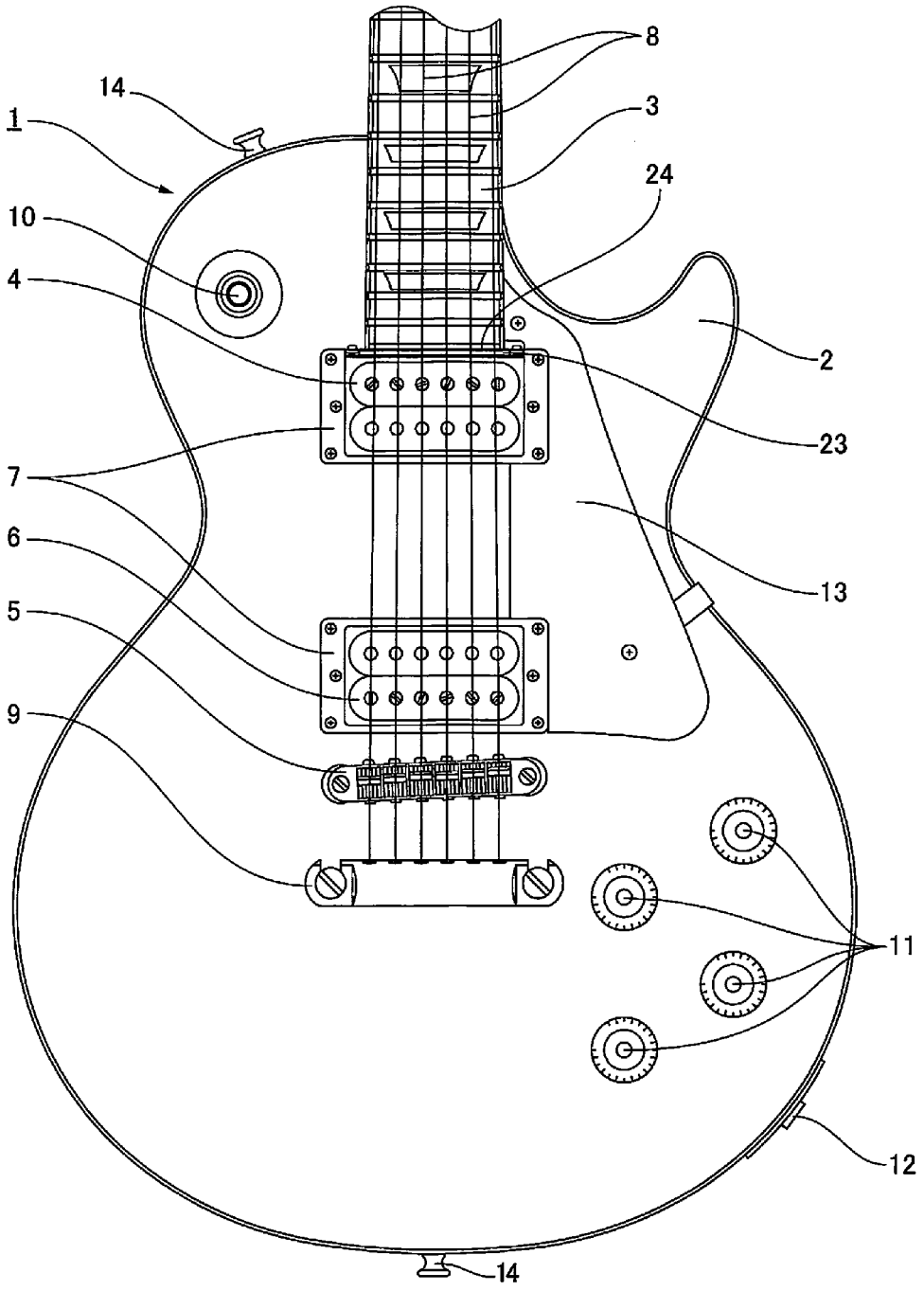
FIG. 1 is an elevational view of an embodied example in which the present invention has been applied to a Gibson type of electric guitar.

In FIG. 1, on an electric guitar 1 of the Gibson type, a front pickup 4 is mounted close to the neck 3, and a rear pickup 6 is mounted close to the bridge 5.

Both the front pickup 4 and the rear pickup 6 are attached to a main body 2 of the electric guitar 1 via respective escutcheons 7.

Figure 2:
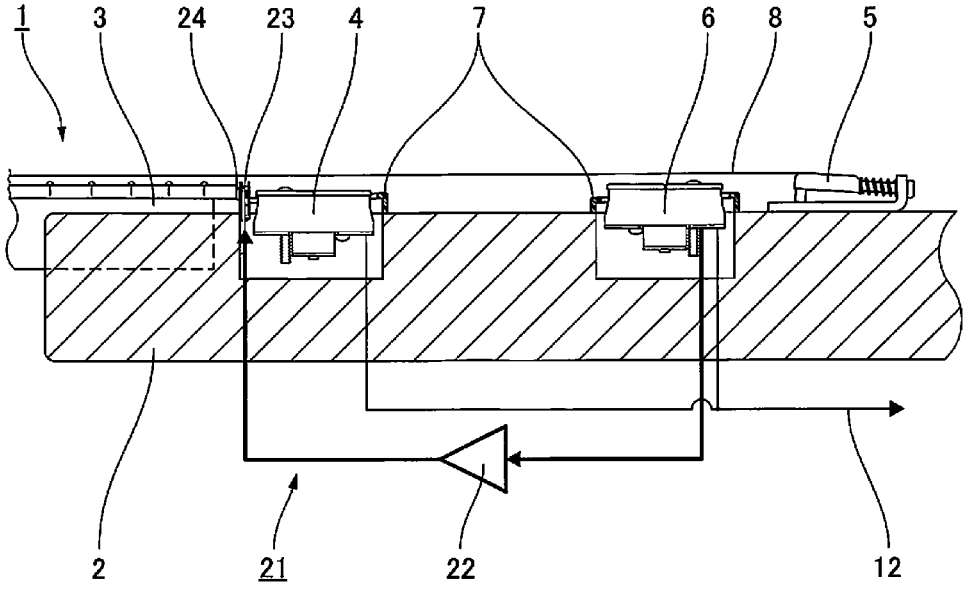
FIG. 2 is a partial view of a side section illustrating a basic configuration of an embodied example of a string vibration sustaining device according to the present embodiment.

A string vibration sustaining device 21 is, as illustrated in FIG. 2, constituted by the rear pickup 6 that detects a frequency of string vibration and converts the detected frequency of the string vibration into an electrical signal, an amplifier 22 that amplifies the converted electrical signal, and an ultrathin electromagnetic driver 23 that converts the amplified electrical signal into a magnetic signal and excites strings 8. The ultrathin electromagnetic driver 23 is arranged in a slight gap between a neck end portion 24 and the front pickup 4 at the main body 2 of the electric guitar 1.

Figure 3A:
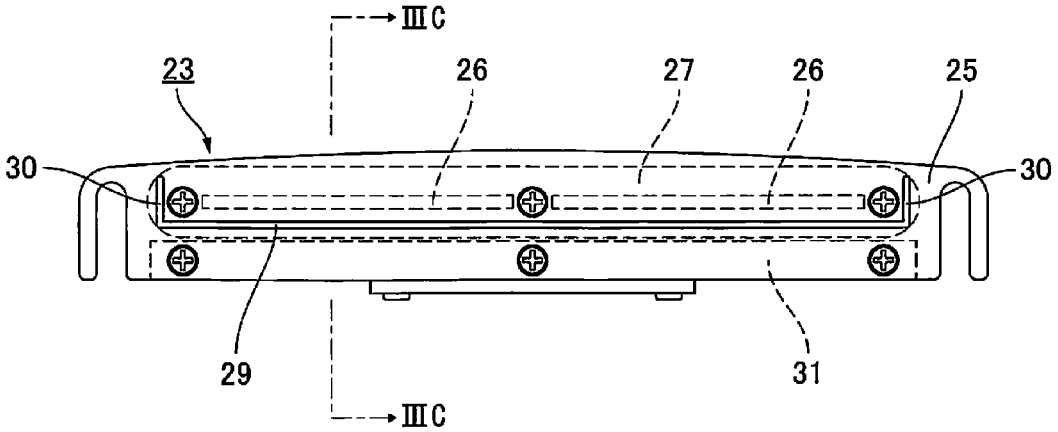
FIG. 3A is an elevational view of an embodied example of an ultrathin electromagnetic driver according to the present embodiment.
Figure 3B:
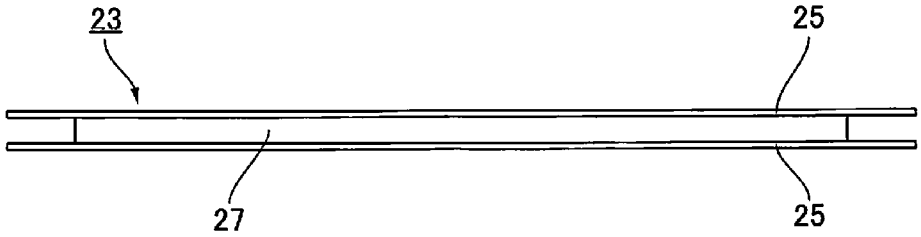
FIG. 3B is a top view of the embodied example of the ultrathin electromagnetic driver according to the present embodiment.
Figure 3C:
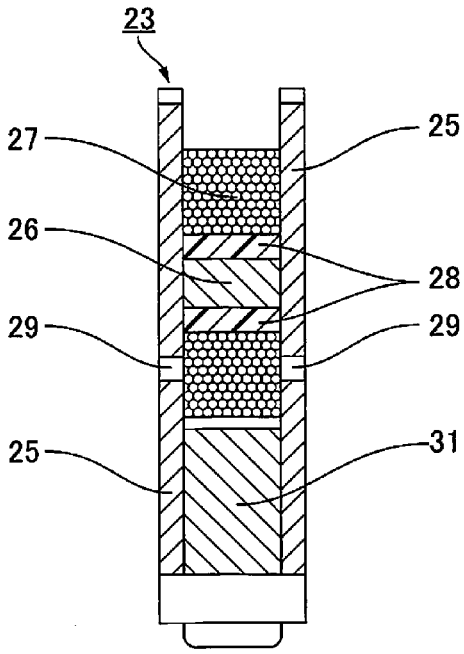
FIG. 3C is an enlarged sectional view taken along the IIIC-IIIC line and illustrating the embodied example of the ultrathin electromagnetic driver according to the present embodiment.

The ultrathin electromagnetic driver 23 is, as illustrated in FIG. 3A, FIG. 3B, and FIG. 3C, constituted by two magnetic pole plates 25 and 25 formed of magnetic materials, a rare earth magnet 26 arranged in parallel with the strings 8 to be positioned between the magnetic pole plates 25 and 25, and a coil 27 wound in a direction perpendicular to the strings 8 around the rare earth magnet 26 via a bobbin 28 formed of an insulating member. The ultrathin electromagnetic driver 23 is formed to have an entire thickness of approximately 3 mm.

The magnetic pole plates 25 are each formed of a magnetic material, e.g., an iron plate to have a thickness of approximately 0.5 mm. A coating treatment is performed on an entire surface of each magnetic pole plate 25 by an insulating and thermally conducting resin (not illustrated) for improving heat radiation.

The rare earth magnet 26 is formed of a rare earth magnet, for example, neodymium magnet for obtaining as large a magnetic force as possible in a small volume.

The coil 27 is formed by winding an ultrafine wire or a line material (e.g., a copper wire having a diameter of approximately 0.1 mm) more tightly and densely than a wound coil of a conventional electromagnetic driver. Thereby, a direct-current resistance component of the coil 27 is increased in order to shift a cutoff frequency toward a high-frequency sound range, i.e., to a frequency equal to or higher than approximately 1300 Hz that is the highest fundamental frequency at a final fret of a first string of a general electric guitar.

The two magnetic pole plates 25 and 25 each include a magnetic resistance slit 29 formed in a horizontal direction, and magnetic resistance slits 30 formed in the vertical direction of the magnetic pole plate 25 from both ends of the magnetic resistance slit 29. These magnetic resistance slits 29 and 30 are formed in the two magnetic pole plates 25 and 25 on the lower side of and on the both right-and-left sides of the rare earth magnet 26 for intensifying a magnetic field on the upper side of the magnetic pole plates 25, and efficiently radiating magnetic energy to the strings 8.

A magnetic member 31 is arranged in a magnetically coupling manner at the lowest portion between the two magnetic pole plates 25 and 25. The magnetic member 31 is formed of a magnetic material, and is provided as a member for absorbing as much magnetic energy radiated to the lower side of the coil 27 of the ultrathin electromagnetic driver 23 as possible, to suppress diffusion of magnetic energy radiated in a direction opposite to the strings 8, i.e., in a lower direction of the ultrathin electromagnetic driver 23 to form a non-open magnetic path, i.e., a closed magnetic path.

Figure 4A:
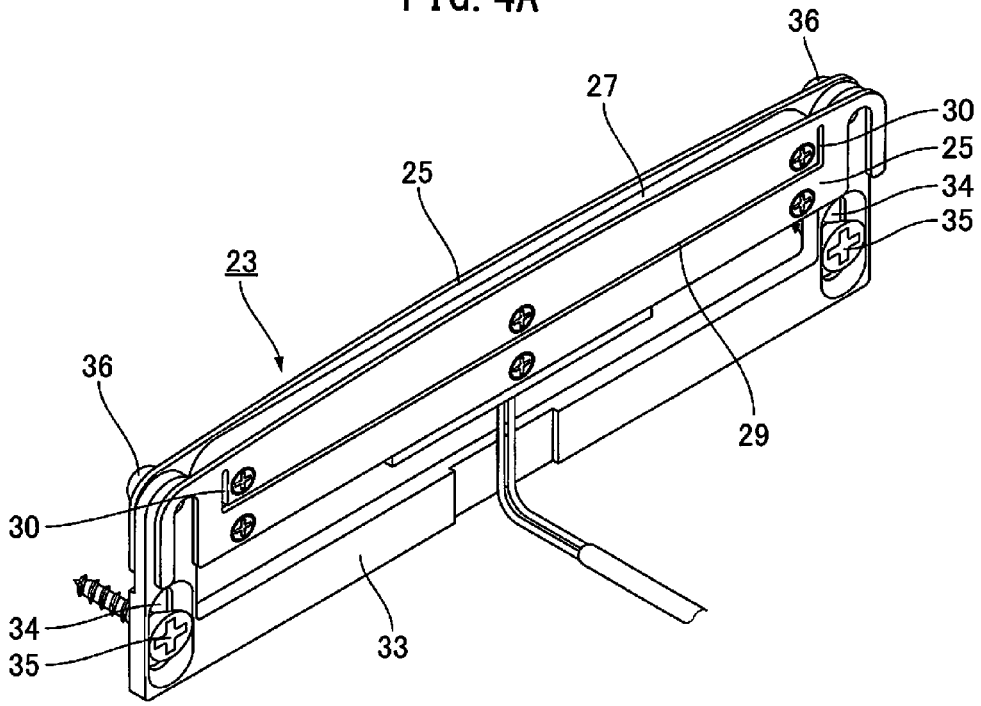
FIG. 4A is an enlarged perspective view of an embodied example of an ascending-and-descending pedestal according to the present embodiment.
Figure 4B:
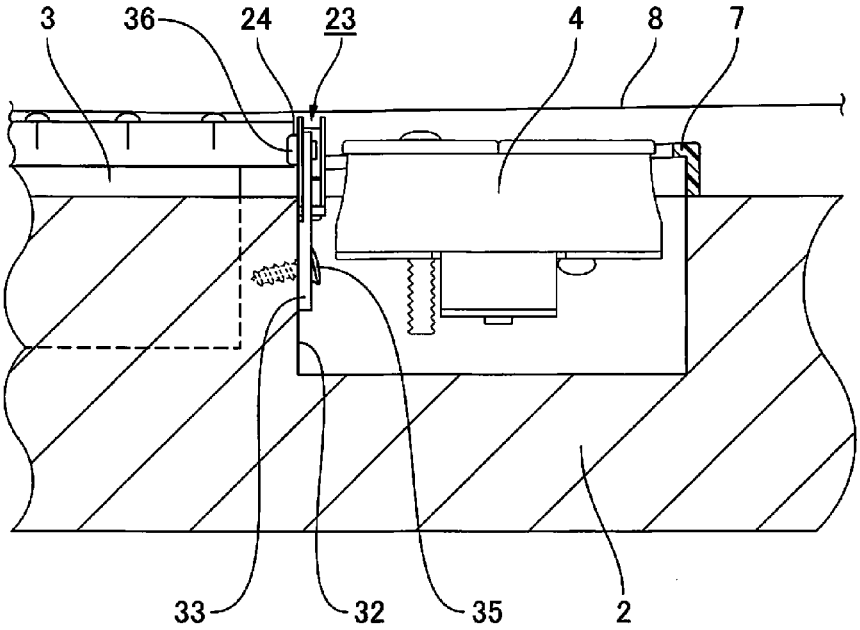
FIG. 4B is a sectional view of an important part of the embodied example of the ascending-and-descending pedestal according to the present embodiment.

The ultrathin electromagnetic driver 23 is, as illustrated in FIG. 4A and FIG. 4B, attached to a main body wall surface 32 at the neck end portion 24 of the main body 2 of the electric guitar 1 via a pedestal 33 ascending and descending in directions toward and away from the strings 8.

The ascending-and-descending pedestal 33 is provided for adjusting a gap between an upper side of the ultrathin electromagnetic driver 23 and the strings 8. The ascending-and-descending pedestal 33 is fixed to the main body wall surface 32 by long attachment holes 34 formed in an elliptical shape and attachment screws 35. The ascending-and-descending pedestal 33 further includes fine-adjustment fixing screws 36 above the long attachment holes 34 and the attachment screws 35.

Figure 5A:
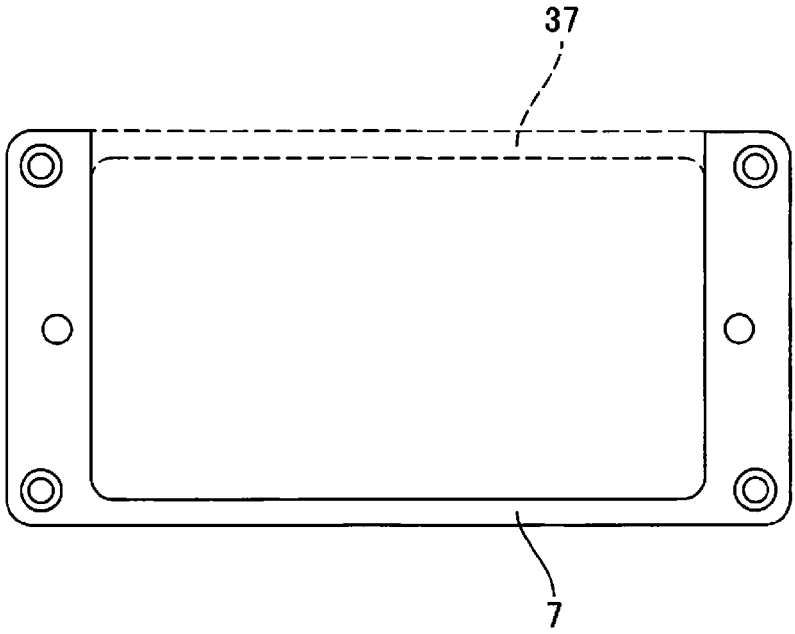
FIG. 5A is a plan view of an embodied example of an escutcheon according to the present embodiment.
Figure 5B:
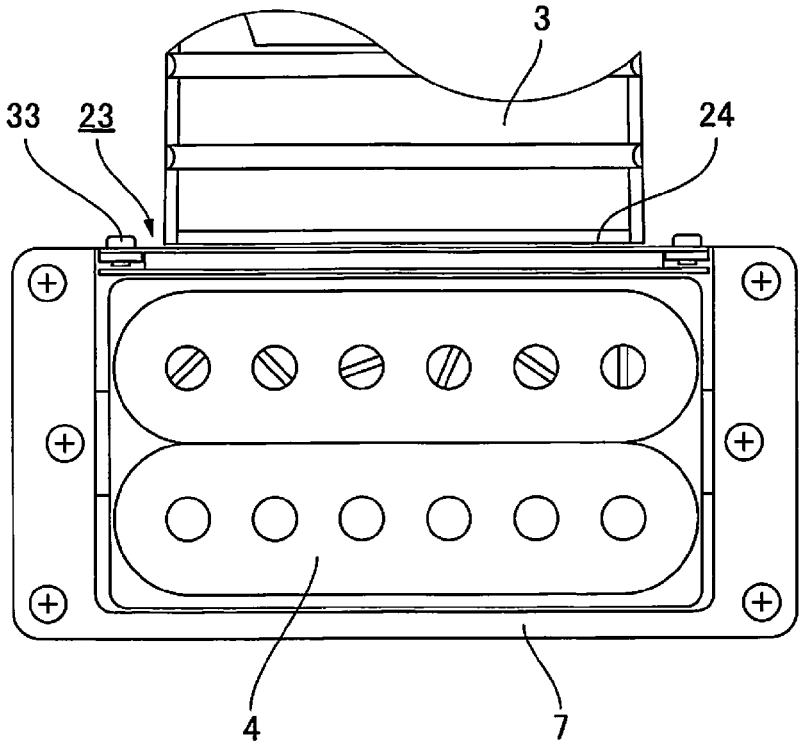
FIG. 5B is a plan view illustrating an attached state of the embodied example of the escutcheon according to the present embodiment.

In the electric guitar 1 of the Gibson type, since the neck end portion 24 and the escutcheon 7 on which the front pickup 4 is mounted are arranged to neighbor each other without a gap, no space for attaching an electromagnetic driver exists originally. For this reason, as illustrated in FIG. 5A and FIG. 5B, a portion that is formed in a frame body of the escutcheon 7 to have a width of approximately 3 mm and that is positioned on the side of the neck 3 is cut off, and in the cut-off space 37, the ultrathin electromagnetic driver 23 is attached to the main body wall surface 32 via the ascending-and-descending pedestal 33.

The amplifier 22 of the string vibration sustaining device 21 is provided inside the body 2 of the electric guitar 1.

Next, an embodied example in which the present invention has been applied to a Fender type of electric guitar is described in detail with reference to FIG. 6. For the same constituent components described above in the Gibson type of electric guitar, the same reference symbols are attached, and a description is omitted.

Figure 6:
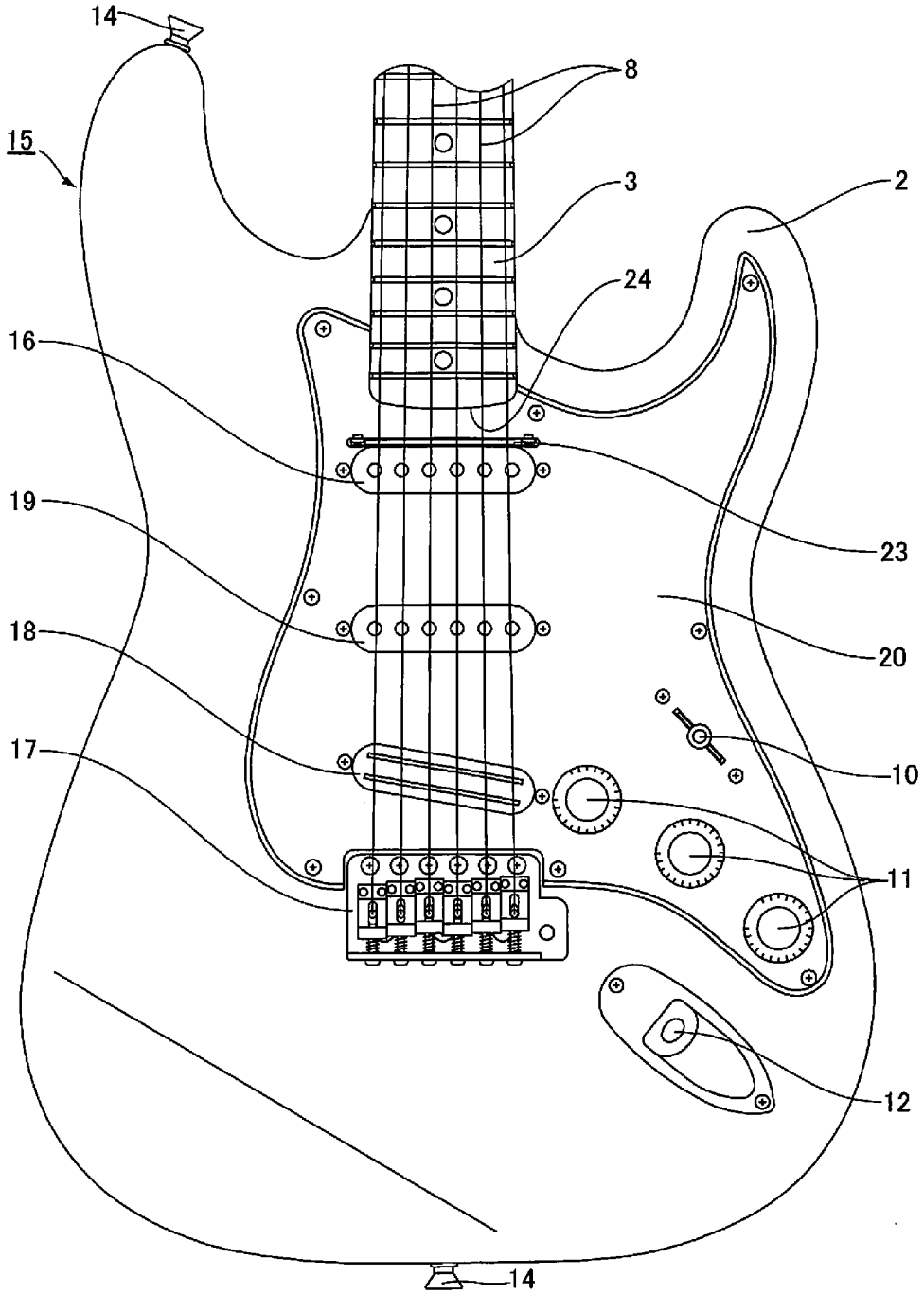
FIG. 6 is an elevational view of an embodied example in which the present invention has been applied to a Fender type of electric guitar.

In FIG. 6, on the electric guitar 15, a front pickup 16 is mounted close to the neck 3, a rear pickup 18 is mounted close to the bridge 17, and a center pickup 19 is mounted at an intermediate position between the front pickup 16 and the rear pickup 18.

Figure 8:
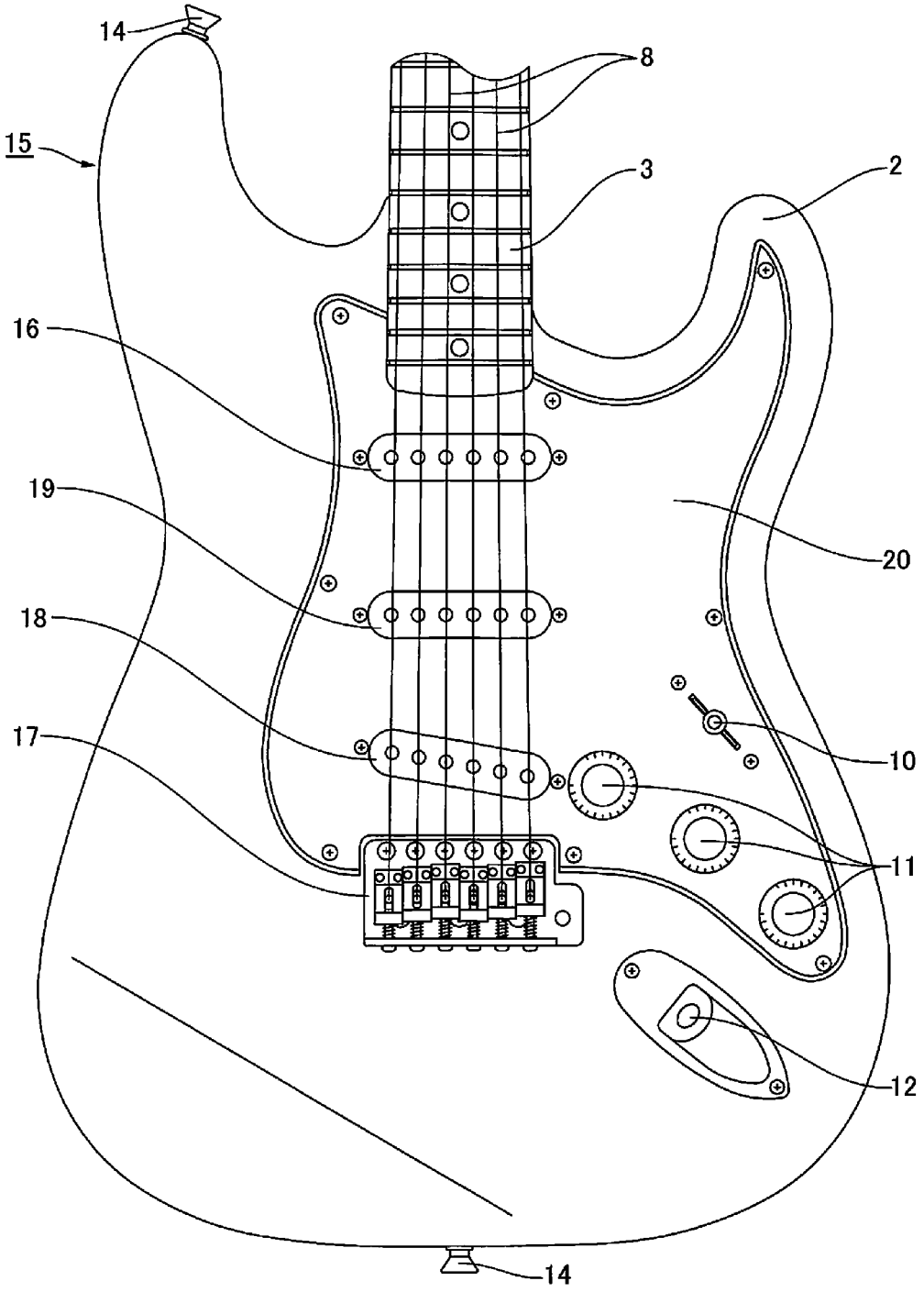
FIG. 8 RELATED ART
FIG. 8 is an elevational view illustrating a general Fender type of electric guitar.

All three of the front pickup 16, rear pickup 18, and center pickup 19 are attached to a main body 2 of the electric guitar 15 via a pick guard 20 formed of a plastic plate. The rear pickup 18 is changed from the single coil pickup of FIG. 8 to a hum-bucking type of pickup for being adapted to a string vibration sustaining device.

The string vibration sustaining device 21 is constituted by the rear pickup 18 that detects a frequency of string vibration, an amplifier 22 that amplifies a detected signal of the rear pickup 18, and an ultrathin electromagnetic driver 23 that converts the amplified electrical signal into a magnetic signal to excite the strings 8. The ultrathin electromagnetic driver 23 is arranged between a neck end portion 24 and the front pickup 16 of the electric guitar 15.

In the case of the Fender type of electric guitar 15, a connection portion between the neck 3 and the main body 2 is strictly designed so that all sections of the connection portion are connected to each other without a gap for regulating a string length. For this reason, a part of the pick guard 20 located adjacent to the neck 3 is cut to a depth of approximately 3 mm so that the ultrathin electromagnetic driver 23 can be attached via an ascending-and-descending pedestal 33 to a main body wall surface on the neck 3 side of the main body, i.e., neighboring the front pickup 16.

Next, description is given regarding an effect of the embodied examples in FIG. 1 and FIG. 6 for both types of the ultrathin electromagnetic driver according to the present embodiment.

Turning on an actuating switch (not illustrated) of the string vibration sustaining device 21 causes the rear pickup 6, 18 to detect vibration of the strings 8, and a part of this detected signal is output as a musical sound signal to an electric amplifier (not illustrated) via an output jack 12.

Another part of the detected signal is output to the amplifier 22 of the string vibration sustaining device 21. The signal amplified by the amplifier 22 is input to the ultrathin electromagnetic driver 23 so that the magnetic energy corresponding to the vibration frequency of the strings 8 is given to the strings 8, the strings 8 are thereby excited continuously, and the strings 8 sustain vibration continuously.

When the actuating switch (not illustrated) of the string vibration sustaining device 21 is turned off, the string vibration signal detected by the rear pickup 6, 18 is not sent to the amplifier 22 so that the ultrathin electromagnetic driver 23 stops giving the magnetic energy to the strings 8.

At this time, switching a pickup selecting switch 10 to select the front pickup 4, 16 causes the front pickup 4, 16 to output a front pickup sound to the electric amplifier (not illustrated) via the output jack 12 in the same manner as a conventional electric guitar.

When the string vibration sustaining device is in an on-state, strong magnetic force of the rare earth magnet 26 effectively magnetizes the strings 8 to achieve an effect of efficiently performing excitation.

Since the coil 27 is formed by tightly winding an ultrafine wire, a direct-current resistance component of the coil 27 is increased. Thereby, a cut-off frequency is shifted to a high-frequency side, i.e., a frequency equal to or higher than approximately 1300 Hz that is the highest fundamental frequency at the final fret of the first string of a general electric guitar. Accordingly, this achieves the effect that the first string can be properly excited as well. Since unit volume of the first string is small and the first string is difficult to magnetize, the first string is a weak point in excitation.

The magnetic resistance slits 29 and 30 are formed on the lower side of and on the both left and right sides of the rare earth magnet 26 in each of the two magnetic pole plates 25 and 25. The magnetic resistance slits 29 and 30 decrease the magnetic energy radiated to the lower side of and to the both left and right sides of the rare earth magnet 26. This achieves the effect that the magnetic field on the upper side of the magnetic pole plates 25 is strengthened, and the magnetic energy is efficiently radiated to the strings 8.

Magnetic member 31 is arranged in a magnetically coupling manner at the lowest portion between the two magnetic pole plates 25 and 25. The magnetic member 31 forms a closed magnetic path between the magnetic pole plates 25 and 25 on the lower side of the rare earth magnet 26. Accordingly, this achieves the effect that the magnetic energy to the lower side of the coil 27 of the ultrathin electromagnetic driver 23 can be effectively absorbed, and diffusion of the magnetic energy radiated in the direction opposite to the strings 8, i.e., in the direction toward the lower side of the ultrathin electromagnetic driver 23 is suppressed as much as possible.

In other words, the ultrathin electromagnetic driver 23 radiates to the strings 8 the magnetic energy for exciting the strings 8, and likewise radiates the magnetic energy also to the lower side where the strings 8 do not exist. The magnetic energy radiated to the strings 8 is absorbed by the strings 8 at the time of the excitation so that a half-closed magnetic path is formed, and for this reason, diffusion of the magnetic energy is naturally suppressed.

Meanwhile, the magnetic energy radiated to the opposite side facing the strings 8 is not absorbed by any objects so that an open magnetic path is formed. A part of this magnetic energy enters into the lower side of the rear pickup 6, 18 to cause the magnetic feedback to be generated. In view of this, the magnetic member 31 absorbs the magnetic energy radiated by the ultrathin electromagnetic driver 23 in the direction opposite to the strings 8 to form a closed magnetic path. This achieves the effect of effectively suppressing the magnetic energy of the ultrathin electromagnetic driver 23 radiated from the side opposite to the strings 8. Accordingly, this leads to the effect of effectively suppressing the magnetic feedback in which a part of the magnetic energy enters the rear pickup 6.

A relatively large electric current is made to flow for exciting the strings so that the ultrathin electromagnetic driver 23 unavoidably generates heat. However, the two magnetic pole plates 25 and 25 are each coated with an insulating and thermally conducting resin (not illustrated) for improving heat radiation to achieve the effect of effectively suppressing an adverse influence given by heat to the rare earth magnet 26 and the coil 27.

The ultrathin electromagnetic driver 23 is attached to the main body 2 via the pedestal 33 ascending and descending in directions toward and away from the strings 8. Adjustment for optimizing a height of the ultrathin electromagnetic driver 23 is performed via the ascending-and-descending pedestal 33 to obtain the effect of making it possible to adjust a height of the ultrathin electromagnetic driver 23 to a position where the excitation becomes maximum, while minimizing an adverse influence such as vibration hindrance and string vibration absorption exerted on the strings 8 by the strong magnetic force of the rare earth magnet 26 radiated from the end of the ultrathin electromagnetic driver 23.

Next, a description is given of advantageous effects of the ultrathin electromagnetic driver according to the present embodiment.

As apparent from the above description, according to the ultrathin electromagnetic driver of the present invention, the ultrathin electromagnetic driver is formed to have a thickness of approximately 3 mm. Accordingly, the ultrathin electromagnetic driver can be mounted in a slight gap between a neck end portion and the front pickup of an electric guitar, which was impossible for a configuration of a conventional electromagnetic driver.

This advantageous effect eliminates a necessity of sacrificing a front pickup for mounting an electromagnetic driver as in a conventional string vibration sustaining device. Accordingly, it is possible to attain the advantageous effect of producing an original sound of the front pickup essential for an electric guitar without a problem.

In such a string vibration sustaining device, the electromagnetic driver and the rear pickup are preferably arranged as far apart from each other as possible so that a part of the magnetic energy radiated from the electromagnetic driver does not enter the rear pickup that detects string vibration. The ultrathin electromagnetic driver according to the present embodiment is mounted farther away than a position of the front pickup that is a position where a conventional electromagnetic driver is mounted to thereby obtain the effect of further suppressing the magnetic feedback.

Further, according to the ultrathin electromagnetic driver of the present invention, a distance between the two magnetic pole plates is as small as approximately 2 mm. Accordingly, by this distance, most of the magnetic radiation for the excitation converges, and for this reason, it is possible to obtain the effect of effectively suppressing a magnetic noise entering the rear pickup, and suppressing the magnetic feedback as much as possible.

Furthermore, the front pickup and the electromagnetic driver can function independently of each other. Accordingly, a necessity of incorporating the front pickup into an amplifying circuit is eliminated, and for this reason, it is possible to obtain the effect that not only is an adverse influence on a sound characteristic eliminated, but also musical performance can be continued even when a battery of the string vibration sustaining device is used up, and in addition, musical performance can be continued even when the string vibration sustaining device itself is not used.

Further, according to the present embodiment, the ultrathin electromagnetic driver is formed to have an extremely thin thickness of approximately 3 mm. Accordingly, it becomes possible to not only incorporate the ultrathin electromagnetic driver at the time of manufacturing an electric guitar, and but also to incorporate the ultrathin electromagnetic driver in any models including an electric guitar having a traditional and typical design, in terms of design. Therefore, the ultrathin electromagnetic driver can be used as a component that is attached to an existing electric guitar after construction so that a practical advantage can be obtained.

When the ultrathin electromagnetic driver is used as a component that is attached to an existing electric guitar, a process for mounting the ultrathin electromagnetic driver can be performed by work as simple as removing a small portion of the main-body of about 3 mm and cutting-off a small portion of the escutcheon or cutting-off a small portion of the pickguard so that a practical advantage can be obtained.

Further, as in the embodied examples, a neodymium magnet having the strongest magnetic flux density is used for the rare earth magnet to thereby obtain the effect that the ultrathin electromagnetic driver having sufficient exciting force even with the ultrathin configuration can be provided.

As in the embodied examples, an ultrathin wire thinner than a line material adopted in a conventional electromagnetic driver is used and wound more tightly to form a coil so that a direct-current resistance component of the coil is increased. Accordingly, the cut-off frequency can be shifted to a high-frequency sound range, i.e., to a frequency equal to or higher than approximately 1300 Hz that is the highest fundamental frequency at the final fret of the first string of a general electric guitar. Therefore, the advantageous effect can be obtained in that the first string of which unit volume is small, that is difficult to magnetize, and that is also a weak point in excitation can be properly excited as well.

Further, as in the embodied examples, the two magnetic pole plates are coated with an insulating and thermally conducting resin to obtain the advantageous effect that a heat radiating effect of the ultrathin electromagnetic driver is improved to effectively suppress degradation of the neodymium magnet and degradation of the coil.

As in the embodied examples, the magnetic resistance slits are formed in each of the two magnetic pole plates on the lower side of the rare earth magnet and/or on the both left and right sides of the rare earth magnet to thereby obtain the advantageous effect that the magnetic field above the magnetic pole plates can be strengthened, and the magnetic energy can be efficiently given to the strings.

As in the embodied examples, the magnetic member is arranged in a magnetically coupling manner in the ultrathin electromagnetic driver below the coil to maximize suppression of magnetic field diffusion of the magnetic energy to the lower side of the ultrathin electromagnetic driver. Thereby, by the magnetic member, a closed magnetic path is formed. Accordingly, the advantageous effect is obtained in that diffusion of the magnetic energy radiated from the lower side of the ultrathin electromagnetic driver is effectively suppressed, and what is called magnetic feedback in which a part of the magnetic energy radiated from the ultrathin electromagnetic driver enters the rear pickup is suppressed as much as possible.

As in the embodied examples, the ultrathin electromagnetic driver is attached to the electric guitar main body via the an ascending-and-descending pedestal ascending toward and descending apart from the strings to obtain the advantageous effect that exciting force for driving the strings and an adverse influence given to string vibration by the magnetic force of the electromagnetic driver can be balanced extremely finely and efficiently.

Furthermore, as in the embodied examples, in a gap formed by cutting off the escutcheon of the front pickup, the ultrathin electromagnetic driver is attached to the main body wall surface via the ascending-and-descending pedestal. Thereby, the ultrathin electromagnetic driver can be attached also in the gap between the front pickup and the neck end portion of the Gibson type in which an attachment space does not originally exist. This achieves the practical outstanding advantage that the ultrathin electromagnetic driver according to the present embodiment can be easily attached to this type of electric guitar afterward.

The example in which a neodymium magnet is used as one example of the rare earth magnet is described above in the embodied examples. However, the present invention is not limited to this. For example, a strong rare earth magnet such as a samarium cobalt magnet may be used.

The above description in the embodied examples is given for an example in which the ultrafine wire is tightly wound for increasing a direct-current resistance component of the coil to thereby shift the cut-off frequency to a high-frequency side. However, the present invention is not limited to this. For example, in the case of the application to a relatively easily excited electric guitar such as an electric guitar that does not need strong excitation or an electric guitar that is designed to have a long scale or low tension, the ultrafine wire may be replaced with a wire that is the same as that of a conventional coil.

The above description in the embodied examples is given for an example in which the magnetic resistance slits are formed in each of the two magnetic pole plates on the lower side of the rare earth magnet and/or on the both left and right sides of the rare earth magnet. However, the present invention is not limited to this. For example, in the case of application to a relatively easily excited electric guitar such as an electric guitar that does not need strong excitation or an electric guitar that is designed to have a long scale or low tension, any number of magnetic resistance slits may be formed, or the magnetic resistance slits themselves may be omitted.

The above description in the embodied examples is given for an example in which each of the two magnetic pole plates is coated with an insulating and thermally conducting resin for improving heat radiation effect. However, the present invention is not limited to this. For example, in the case of application to a relatively easily excited electric guitar such as an electric guitar that does not need strong excitation or an electric guitar that is designed to have a long scale or low tension, a small driving electric current can basically suffice, and generated heat can be made small so that coating of the insulating and thermally conducting resin may be omitted.

Further, although a description in the embodied examples is omitted in the above, the electromagnetic pole plates themselves may be formed to have a heat radiation configuration for improving heat radiation effect. In other words, formation of minute fins, emboss processing, or formation of a wave shape may be performed for increasing a surface area.

The above description in the embodied examples is given for an example in which the magnetic member is magnetically coupled to the ultrathin electromagnetic driver below the coil to form a magnetically closed magnetic path for maximizing suppression of magnetic field diffusion to the lower side of the coil. However, the present invention is not limited to this. For example, the magnetic member may be arranged at a separate position in the ultrathin electromagnetic driver below the coil to form a magnetically half-closed magnetic path.

Furthermore, for example, in the case of application to a relatively easily excited electric guitar such as an electric guitar that does not need strong excitation or an electric guitar that is designed to have a long scale or low tension, a driving electric current can be made small to make the magnetic feedback itself small, and for this reason, the magnetic member may be omitted.

The above description in the embodied examples is given for an example in which the ultrathin electromagnetic driver is attached to the main body wall surface on the neck side in the front pickup of the electric guitar main body via the an ascending-and-descending pedestal ascending toward and descending apart from the strings. However, the present invention is not limited to this. For example if the optimum mounting position has been determined by strict space designing performed in advance, or e.g., in the case of application to a relatively easily excited electric guitar such as an electric guitar that does not need strong excitation or an electric guitar that is designed to have a long scale or low tension, the ascending-and-descending pedestal may be omitted.

The present invention can be applied to an electromagnetic driver using a string vibration sustaining device mounted on an electric guitar including an electromagnetic pickup. Particularly, the present invention can be applied to an ultrathin electromagnetic driver formed in an ultrathin shape to have an entire thickness that is equal to or smaller than 3 mm and that is a physical limit size so that the ultrathin electromagnetic driver is arranged in a slight gap between a neck end portion and a front pickup of an electric guitar, and the present invention can be applied to an electric guitar on which a string vibration sustaining device including the ultrathin electromagnetic driver is mounted.

The preceding description has been presented only to illustrate and describe exemplary embodiments of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiments disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An ultrathin electromagnetic driver used in a string vibration sustaining device mounted on an electric guitar, wherein the string vibration sustaining device comprises:

a rear pickup that detects a frequency of string vibration, and converts the detected frequency of the string vibration into an electrical signal;

an amplifier that amplifies the converted electrical signal; and the ultrathin electromagnetic driver that converts the amplified electrical signal into a magnetic signal to excite strings;

the ultrathin electromagnetic driver comprises two magnetic pole plates formed of a magnetic material, a rare earth magnet arranged in parallel with the strings to be positioned between the two magnetic pole plates, and a coil wound in a direction perpendicular to the strings around the rare earth magnet, the ultrathin electromagnetic driver is formed in an ultrathin shape to have an entire thickness equal to or smaller than 3 mm, and the ultrathin electromagnetic driver is arranged in a gap between a neck end portion and a front pickup of the electric guitar.

2. The ultrathin electromagnetic driver according to claim 1, wherein the rare earth magnet is a neodymium magnet.

3. The ultrathin electromagnetic driver according to claim 1, wherein an ultrafine wire is tightly wound around the rare earth magnet for increasing a direct-current resistance component of the coil, and thereby shifting a cut-off frequency to at least 1300 Hz on a high-frequency side.

4. The ultrathin electromagnetic driver according to claim 1, wherein the two magnetic pole plates are each coated with an insulating and thermally conducting resin for improving a heat radiation effect.

5. The ultrathin electromagnetic driver according to claim 1, wherein a magnetic resistance slit is formed in each of the two magnetic pole plates on a lower side of and/or on both left and right sides of the rare earth magnet, a magnetic member is arranged in the ultrathin electromagnetic driver below the coil, and the magnetic member forms a magnetically closed magnetic path or a magnetically half-closed magnetic path for maximizing suppression of magnetic energy diffusion toward a lower side of the ultrathin electromagnetic driver.

6. The ultrathin electromagnetic driver according to claim 1, wherein the ultrathin electromagnetic driver is attached to a main body wall surface on a neck side adjacent to a front pickup of an electric guitar main body via an ascending-and-descending pedestal ascending toward and descending away from the strings, and the ultrathin electromagnetic driver is attached via the ascending-and-descending pedestal to a space formed by cutting off a portion of a pickguard and a neighboring front pickup, or a space formed by cutting off a portion of a neck side of an escutcheon.

7. An electric guitar comprising a string vibration sustaining device, wherein the string vibration sustaining device comprises:

a rear pickup that detects a frequency of string vibration, and converts the detected frequency of the string vibration into an electrical signal;

an amplifier that amplifies the converted electrical signal; and an ultrathin electromagnetic driver that converts the amplified electrical signal into a magnetic signal to excite strings;

the ultrathin electromagnetic driver comprises two magnetic pole plates formed of a magnetic material, a rare earth magnet arranged in parallel with the strings to be positioned between the two magnetic pole plates, and a coil wound in a direction perpendicular to the strings around the rare earth magnet, the ultrathin electromagnetic driver is formed in an ultrathin shape to have an entire thickness equal to or smaller than 3 mm, and the ultrathin electromagnetic driver is arranged in a gap between a neck end portion and a front pickup of the electric guitar.

* * * * *